US005462347A

United States Patent [19]

Vogelgesang et al.

[11] Patent Number: 5,462,347

[45] Date of Patent: Oct. 31, 1995

[54] PULL DOWN STORAGE SHELF ASSEMBLY

[76] Inventors: Doug Vogelgesang, P.O. Box 2564; Douglas Ching, P.O. Box 1388, both of Kailua-Kona, Hi. 96745

[21] Appl. No.: 162,277

[22] Filed: Dec. 6, 1993

Related U.S. Application Data

[63] Continuation-in-part of Ser. No. 932,984, Aug. 20, 1992, Pat. No. 5,308,158.

[51] Int. Cl.[6] ..... A47F 5/08

[52] U.S. Cl. ..... 312/247; 312/319.3; 312/325

[58] Field of Search ..... 312/319.3, 319.2, 312/270.2, 270.3, 325, 247, 248, 321.5, 266; 211/170

[56] References Cited

U.S. PATENT DOCUMENTS

| | | | |
|---|---|---|---|
| 159,501 | 2/1875 | Cogswell . | |
| 2,590,341 | 3/1952 | Nabholz | 312/319.3 |
| 2,855,262 | 10/1958 | Sharpe . | |
| 3,081,138 | 3/1963 | Stebbins | 312/319.3 |
| 3,224,827 | 12/1965 | Foster et al. . | |
| 3,278,250 | 10/1986 | Vogt . | |
| 3,347,591 | 10/1967 | Soroos et al. . | |
| 3,390,930 | 7/1968 | Peterson . | |
| 3,734,588 | 5/1973 | Ellis . | |
| 4,026,434 | 5/1977 | Howard . | |
| 4,076,351 | 2/1978 | Wyant . | |
| 4,134,629 | 1/1979 | Hansen . | |
| 4,915,461 | 4/1990 | Kingsborough et al. . | |
| 5,058,846 | 10/1991 | Close . | |
| 5,308,158 | 5/1994 | Vogelgesang | 312/319.3 |

FOREIGN PATENT DOCUMENTS

| | | |
|---|---|---|
| 2524962 | 12/1976 | Germany . |
| 3001860 | 7/1981 | Germany . |

*Primary Examiner*—Kenneth J. Dorner
*Assistant Examiner*—Gerard A. Ardirsv
*Attorney, Agent, or Firm*—Flehr, Hohbach, Test, Albritton & Herbert

[57] ABSTRACT

A pull down shelf assembly (20) for facilitating access to an upper storage shelf (22). The storage shelf (22) is movably mounted to a shelf guide track mechanism (23, 23') for movement between an extended position and a retracted position. The pull down assembly (20) includes a pantographic assembly (25, 25') which is mounted to a support member (21) by a shelf mounting bracket member (24). The pantographic assembly includes a pair of arms (26, 27) pivotally mounted to the track mechanism (23, 23') and the mounting bracket member (24, 24') at spaced-apart locations. This configuration produces pantographic movement of the track mechanism (23, 23') throughout an arcuate path between a deployed position and an elevated stored position while maintaining the horizontal orientation of the shelf (22) throughout the pantographic movement. A shelf locking mechanism (35, 35') locks the shelf (22) in the extended position during pantographic movement between the elevated stored position and the deployed position.

24 Claims, 4 Drawing Sheets

PULL DOWN STORAGE SHELF ASSEMBLY

RELATED APPLICATION

This application is a continuation-in-part application based upon parent application Ser. No. 07/932,984, filed Aug. 20, 1992 and entitled PULL DOWN STORAGE SHELF ASSEMBLY, now U.S. Pat. No. 5,308,158.

TECHNICAL FIELD

The present invention relates, generally, to wall mounted storage systems, and, more particularly, to wall mounted storage systems for cabinets which raise or lower a storage shelf while maintaining a level orientation.

BACKGROUND ART

Storage shelves positioned in high places are often inaccessible to certain groups of individuals. For instance, children, the elderly and persons of shorter stature often have difficulty or are unable to reach and retrieve items stored on shelves placed high up in storage devices. Tall hallway closets or wall mounted cabinets positioned above large household appliances pose particularly difficult problems. These individuals must precariously stand on stools, ladders or the like so that they may access the stored items from the upper shelves. This practice is often dangerous, especially for children and the elderly.

Moreover, these problems are magnified for the handicapped where top shelf accessibility is even more remote. When seated in their wheelchair, retrieval of any item outside of their immediate reach is extremely difficult. Hence, most of the middle to upper storage capacity of a storage device is of little use to a handicapped person without additional aid.

In an effort to increase accessibility to the upper shelving of conventional cabinets, particularly of the wall mounted type, storage assemblies may be retrofit with pull down devices which raise or lower the shelves so that these certain groups of individuals can reach or access the stored items. These devices generally include a pantographic framework pivotally mounted to a shelf or shelves which swing the shelves outwardly and downwardly from the upper cabinets to a deployed, lowered, position for more convenient access. Generally, these devices lower the shelves while maintaining an ordinarily level orientation. Typical patented, prior art, pull down retrieval systems set may be found in U.S. Pat. No. 5,058,846 to Close; U.S. Pat. No. 4,915,461 to Kingsborough et al.; U.S. Pat. No. 4,134,629 to Hansen; U.S. Pat. No. 4,076,351 to Wyant; U.S. Pat. No. 4,026,434 to Howard; U.S. Pat. No. 3,347,591 to Soroos et al.; U.S. Pat. No. 159,501 to Cogswell; and German Patent No. 2,524,962 to Kurz.

While these assemblies may been adequate to permit access of the storage assembly from the raised position, most are deficient for one reason or another. For example, the prior art assemblies do not permit the shelves, once lowered, to be pulled or extended forward for additional access. This motion provides even greater access to the storage shelf because the shelf may be moved clear of the pantographic framework where the shelves are stacked atop one another. This is especially true in multiple shelf assemblies.

In addition, many of the assemblies are inherently complex, requiring an array of pulley and linkage mechanisms, and springs biasing systems necessary to raise and lower the shelves. The Hansen patent, for instance, discloses a pantographic framework having individual link members intercoupled between a wall mounted frame, a pull down shelf, the ceiling and a folding door. This complex linkage assembly, requiring numerous parts, is very difficult to use and assemble.

Other pull down assemblies provide costly and complex mechanisms which facilitate retraction of the deployed, lowered, shelf back to the stored position. The Kingsborough patent employs an electric motor coupled to the pull down linkage mechanism by a flexible cord which draws the lowered shelf back to the stored position. This mechanism is slow to use and must be reversed to deploy the shelf to the lowered position.

The Close, Wyant, Howard and Kurz patents, on the other hand, disclose pull down storage assemblies including complex pulley mechanisms or spring biasing devices configured to bias the shelf toward the raised position. These prior art assemblies include coiled springs coupled between a stationary fixture, such as a wall mounting frame, and the pull down linkage mechanism. Upon deployment of the shelf to the lowered position, the coiled springs are extended which urge the shelves back to the elevated position. Accordingly, as the user pushes the lowered shelf upward to the elevated position, the spring biased device facilitates upward movement of the shelf.

Accordingly, it is an object of the present invention to provide a pull down storage shelf assembly which permits increased access to the upper shelves of storage devices.

It is another object of the present invention to provide a pull down storage shelf assembly which efficiently urges the deployed shelf back to a stored position.

Still another object of the present invention is to provide a pull down storage shelf assembly which automatically limits the extension of a linkage assembly upon deployment to a lowered position.

It is another object of the present invention is to provide a pull down storage shelf assembly which can be easily and safely operated by children, the elderly and handicapped persons.

Yet another object of the present invention is to provide a pull down storage shelf assembly which can be easily retrofit to and installed in existing storage devices.

It is a further object of the present invention to provide a pull down storage shelf assembly which is durable, compact, easy to maintain, has a minimum number of components, is easy to use by unskilled personnel, and is economical to manufacture.

DISCLOSURE OF INVENTION

The present invention includes a pull down shelf assembly having a shelf guide track mechanism and a storage shelf mounted to the track mechanism for movement of the shelf between an extended position and a retracted position. A pantographic pull down mounting assembly produces pantographic movement of the track mechanism, and hence, the storage shelf between a deployed position and an elevated stored position. The pantographic mounting assembly includes a shelf mounting bracket formed for mounting of the shelf assembly to a support member, and a pair of arms which are pivotally mounted at first ends of the arms to the track mechanism at spaced apart locations. The second ends of the arms are pivotally mounted to the shelf mounting bracket at spaced apart locations. The pair of arms are mounted to the shelf mounting bracket and the track mechanism at locations producing pantographic movement of the track mechanism with the storage shelf carried thereby and oriented in a near-horizontal orientation throughout an arcuate path between the deployed position and the elevated stored position. A shelf locking mechanism is provided which includes a pin member movably mounted to either the track mechanism or the one arm of the pair of arms between a disengaged position and an engaged position. In the engaged position, the pin member is positioned for engagement with the shelf member to prevent the shelf member from moving from the extended position upon movement of the track mechanism between the elevated stored position and the deployed position.

In another aspect of the present invention, the pull down shelf assembly includes a spring biasing mechanism coupled between the mounting bracket and one of the arms which biases the track mechanism toward the stored position. Briefly, a helical spring member is provided tensioned about a spring axis which is coupled between the mounting bracket and one arm in a manner positioning the spring axis in substantial coaxial alignment with the respective arm pivotal axis. A spring tension adjustment mechanism is coupled to the spring member to adjust the tension thereof about the spring axis relative the track mechanism.

Further, the pantographic assembly may include a pair of laterally spaced-apart pantographic assemblies positioned on opposite sides of the shelf member. A torsion bar may be provided which extends laterally between one pantographic assembly to the other pantographic assembly of the pair of pantographic assemblies.

BRIEF DESCRIPTION OF THE DRAWING

The purpose and advantages of the present invention will be apparent to those skilled in the art from the following detailed description in conjunction with the appended drawings in which.

BEST MODE OF CARRYING OUT THE INVENTION

The pull down storage shelf assembly of the present invention provides accessibility to the upper shelves of a cabinet, while further, facilitating retraction of the track mechanism back to an elevated stored position. While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention, as defined by the appended claims.

Figure 1A:
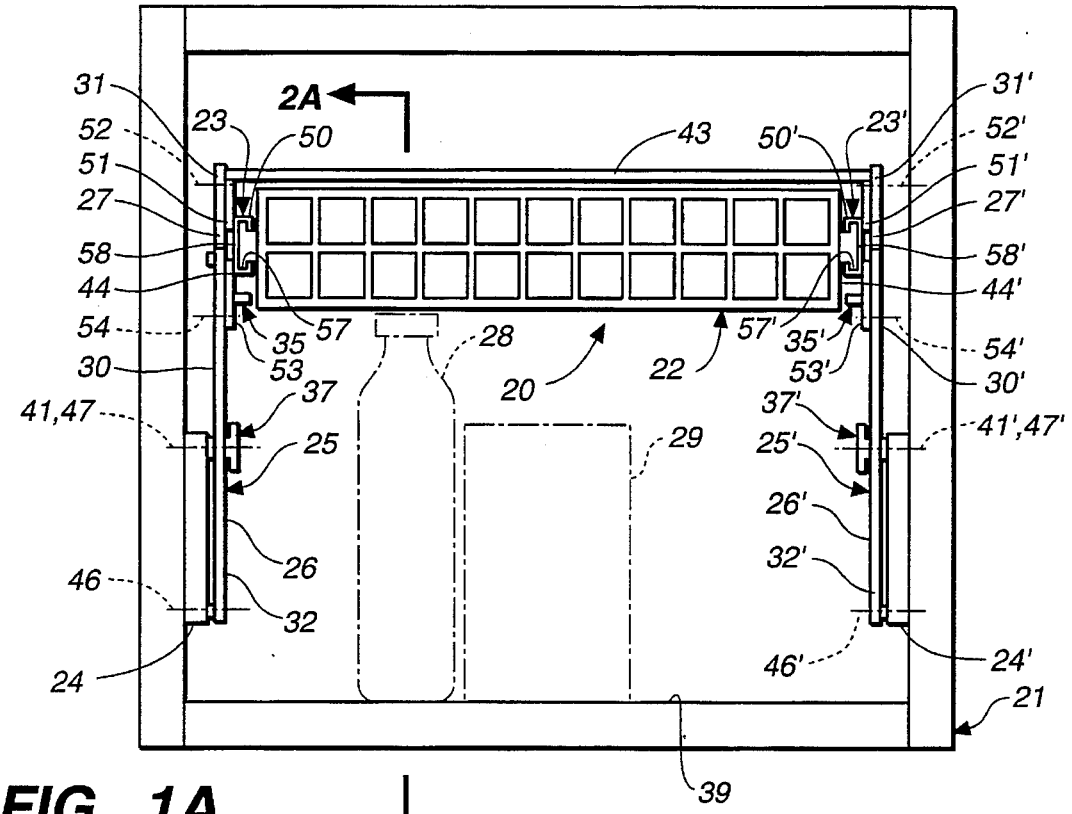
FIGS. 1A and 1B are a series of front elevation views of a pull down shelf assembly of the present invention mounted in a cabinet and illustrating movement between a deployed position and an elevated stored position.
Figure 1B:
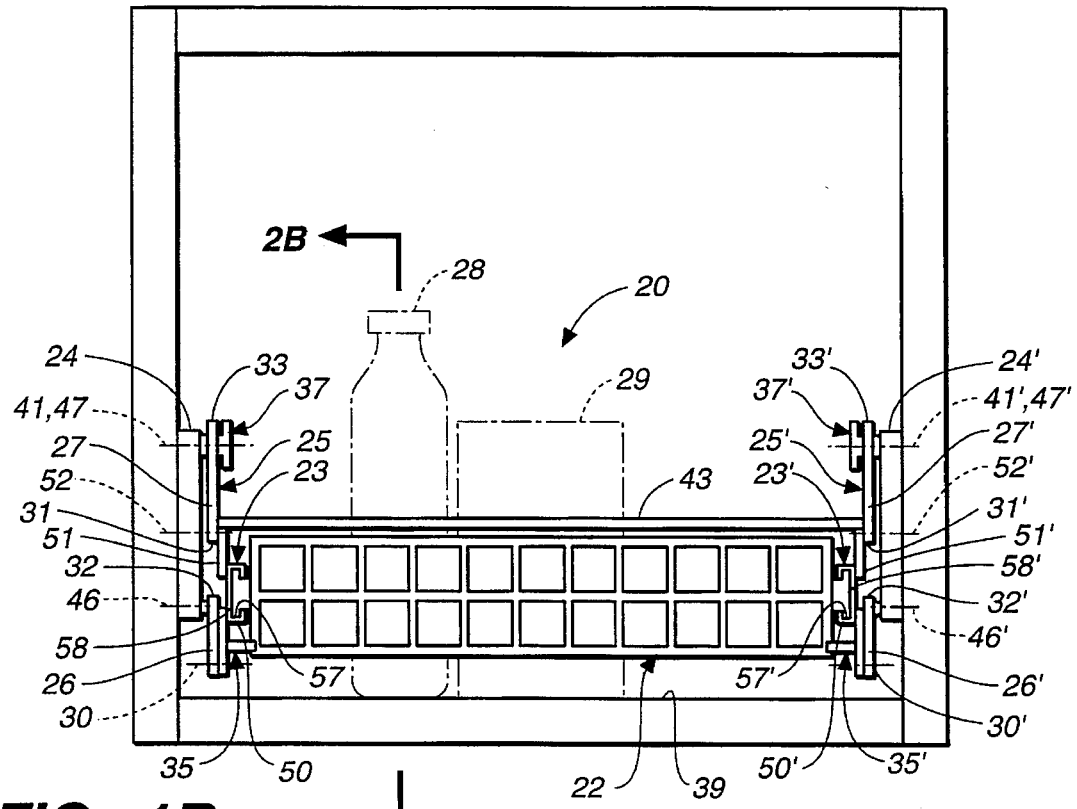

It will be noted here that for a better understanding, like components are designated by like reference numerals throughout the various figures. Attention is now directed to FIGS. 1A and 1B where a pull down shelf assembly, generally designated 20, is illustrated mounted inside a cabinet support member 21. Briefly, pull down shelf assembly 20 of the present invention is comprised of a shelf member, generally designated 22, movably mounted to a track mechanism, generally designated 23, for movement between an extended position (phantom lines in FIG. 2A) and a retracted position (solid lines in FIG. 2A). Shelf member 22 is formed to support items to be stored or accessed (not shown) in the upper regions of cabinet support member 21.

Pull down assembly 20 includes at least one pantographic assembly, generally designated 25, which is mounted to support member 21 by a shelf mounting bracket member 24. The pantographic assembly includes a pair of arms, generally designated 26 (front arm) and 27 (rear arm), pivotally mounted at first ends 30, 31, respectively, to track mechanism 23 at spaced-apart locations. Each opposite second end 32, 33 of arms 26, 27, respectively, is pivotally mounted to mounting bracket member 24. This configuration produces pantographic movement of track mechanism 23 throughout an arcuate path between a deployed position (FIG. 2B) and an elevated stored position (FIG. 2A) while maintaining shelf member 22 in a substantially horizontal orientation throughout the pantographic movement.

Accordingly, the stored items placed on the shelf member may be vertically repositioned through the arcuate lowering (via pantographic assembly 25) of the track mechanism and moved forward (via track assembly 23) without substantially disturbing the placement of the stored items relative one another.

Figure 4A:
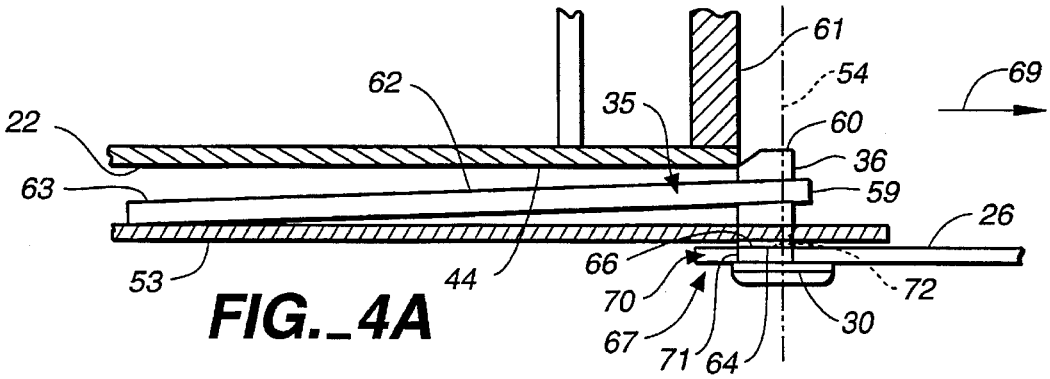
FIGS. 4A and 4B are a series of top plan views, in cross-section, of the pull down shelf assembly taken substantially along the plane of line 4—4 in FIG. 3 and illustrating movement of the components of the shelf locking mechanism between the engaged position and the disengaged position.

In accordance with the present invention, a shelf locking mechanism, generally designated 35, is provided which includes a pin member 36 movably mounted to either the track mechanism or one of the arms (26 or 27) of the pair of arms between a disengaged position (FIG. 4B) and an engaged position (FIG. 4A). In the engaged position, pin member 36 is positioned for contact with shelf member 22 to prevent the shelf member from moving from the extended position upon movement of the track mechanism between the elevated stored position and the deployed position. That is, preferably once the shelf member is moved to the extended position, it cannot subsequently be manually moved back toward the retracted condition until the track mechanism is moved up to the elevated stored position. Hence, when two pull down shelf assemblies are stacked atop one another (not shown), or when a pull down assembly is above a stationary shelf 39, the upper shelf member, in the extended position, will clear and will not interfere with the stored items 28,29 in lower or stationary shelf member 39 as the upper shelf assembly 20 moves between the elevated stored position and the deployed position. Thus, the present invention is particularly suitable for stacking on two or more shelf assemblies. It will be appreciated that the main concern is to prevent movement of the shelf member from the extended position to the retracted position while the track mechanism is moved between the stored position and the deployed position. Hence, track mechanism could be configured to move between the extended and retracted positions while track mechanism is in the deployed condition.

Further, pull down shelf assembly 20 may include a spring biasing mechanism, generally designated 37, coupled between mounting bracket member 24 and one of the arms 26, 27 to bias track mechanism 23 toward the stored position. Briefly, biasing mechanism includes a helical spring 40 which is tensioned about a spring axis 41 and coupled between the mounting bracket and the one arm in a manner positioning the spring axis in substantial coaxial alignment with the respective arm pivotal axis. A spring tension adjustment mechanism, generally designated 42, is coupled to helical spring 40 to adjust the tension thereof about the spring axis relative the track mechanism. Accordingly, the amount of force, acting on the one arm to bias the pantographic assembly (helical spring 40) toward the elevated stored position, can be adjusted to increase or decrease the amount of tension.

Moreover, the pantographic assembly may include a pair of laterally spaced-apart pantographic assemblies 25, 25' (FIGS. 1A and 1B) positioned on opposite sides of shelf member 22. In this arrangement, a torsion bar, generally designated 43, is preferably positioned between the spaced-apart assemblies 25, 25' to increase the torsional stability between the pantographic assemblies during movement of the track mechanism between the deployed position and the elevated stored position.

Figure 2A:
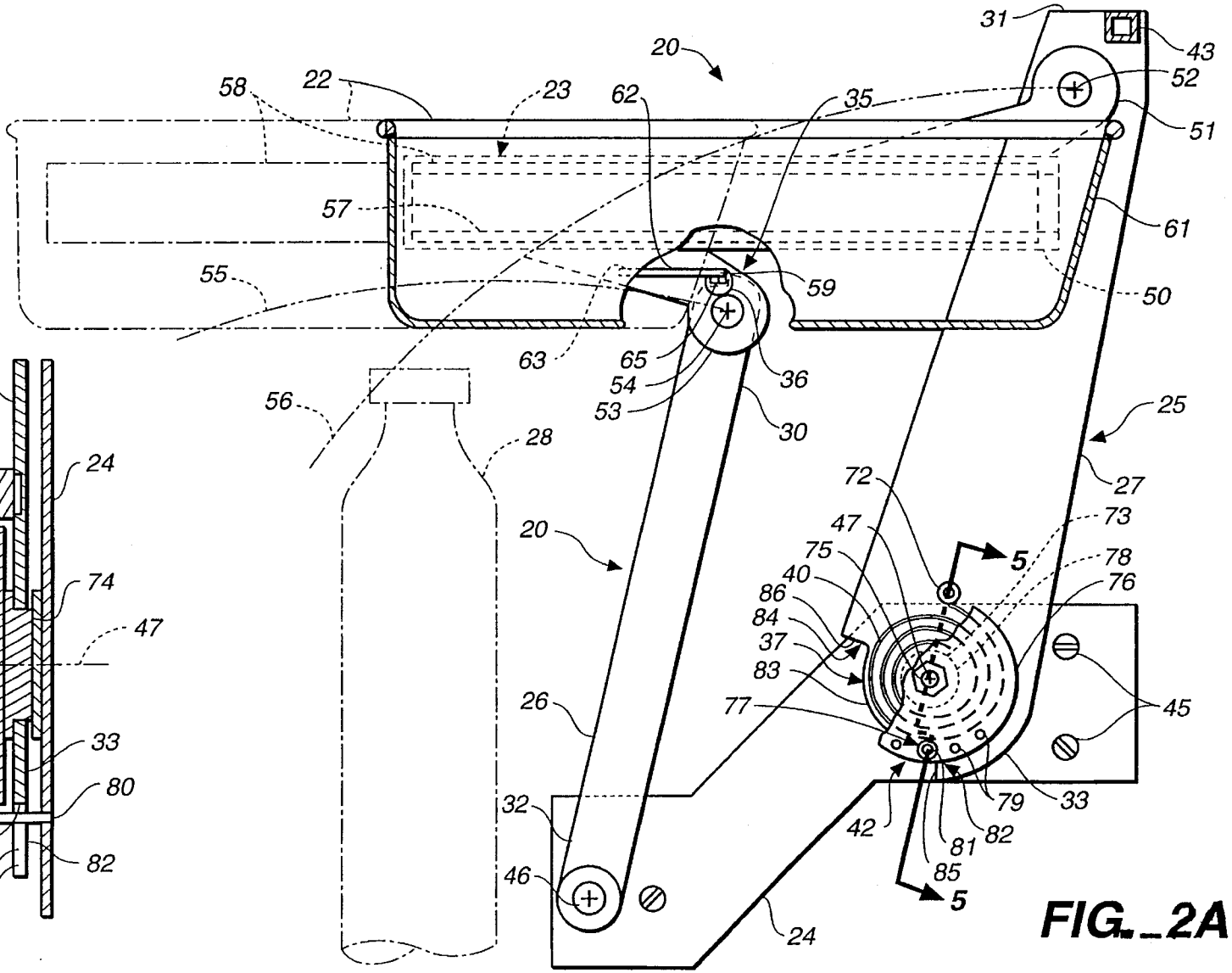
FIGS. 2A and 2B are a series of enlarged, fragmentary, side elevation views, in cross-section, of the pull down shelf assembly taken substantially along the plane of line 2—2 in FIGS. 1A and 1B, respectively, and illustrating movement of a shelf member between the extended position and the retracted position.
Figure 2B:
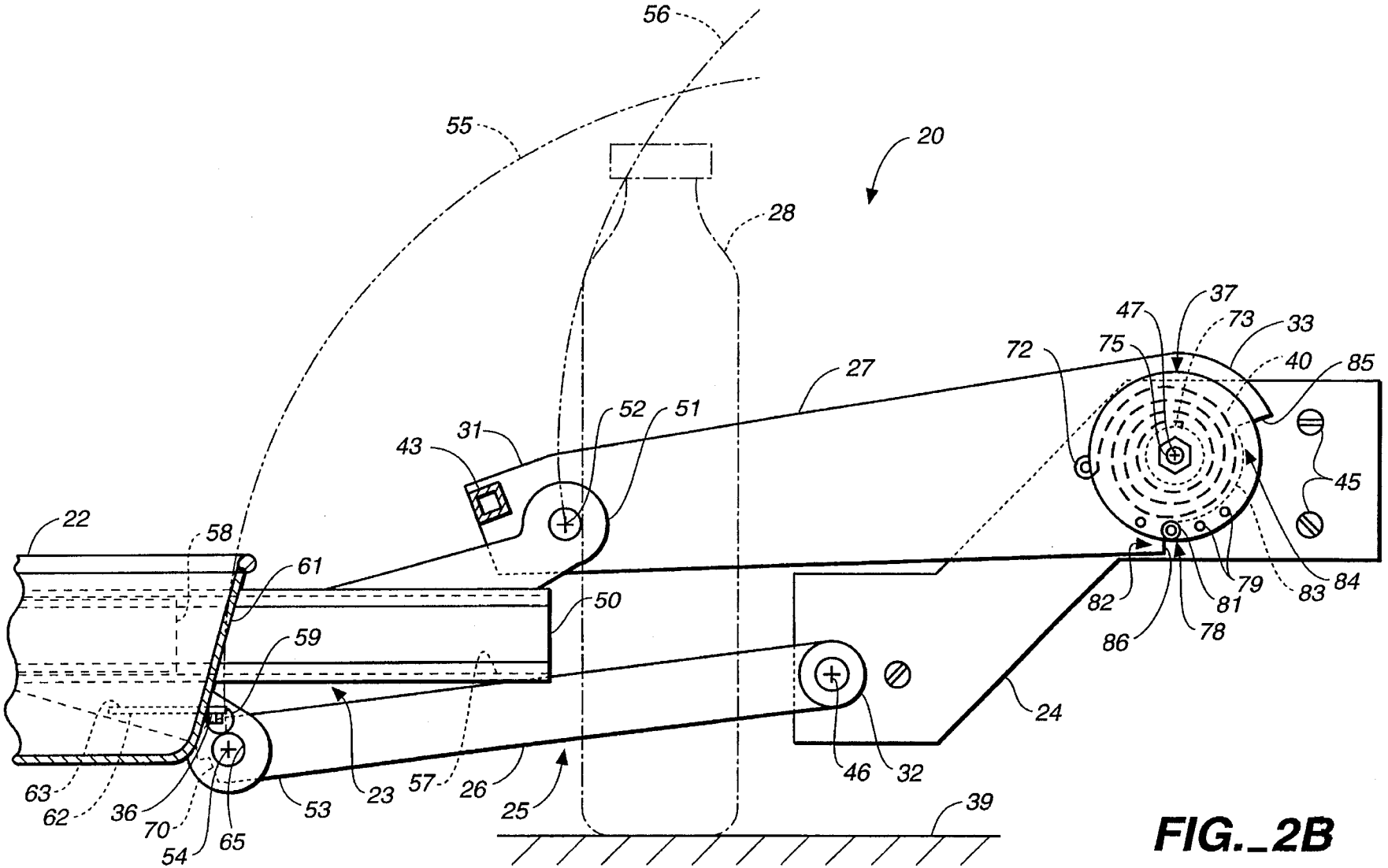

Attention will now be directed to FIGS. 1 and 2 where pull down assembly 20 is shown mounted to cabinet support member 21. In the elevated stored position (FIGS. 1A and 2A) track mechanism 23 is positioned in the upper regions of storage cabinet support 21. Hence, shelf member 22, carried by track mechanism 23, is also located at its highest position relative to support member 21. In contrast, in the deployed position (FIGS. 1B and 2B), shelf member 22 is vertically positioned at the lowest position forward of cabinet support member 21 where items stored in shelf member 22 are more accessible. Incidently, shelf member 22 may comprise any container, tray, basket, planar shelf or the like which is formed and dimensioned to hold items to be stored. Moreover, shelf member 22 may include more than one shelf member 22 stacked or housed in shelf assembly 20, such as a rotatable "lazy susan" shelf.

In the preferred embodiment, pantographic assembly is provided by a pair of mirror-image pantographic assemblies 25, 25' (FIG. 1) which are positioned on opposite sides 44, 44' of shelf member 22. Pantographic assemblies 25, 25', movably supporting shelf member 22, act in concert to vertically reposition track mechanism 23 between the deployed position and the stored position. It will be understood, however, that a single pantographic assembly could be employed, intermediate shelf member 22 for example, without departing from the true spirit and nature of the present invention.

Essentially, each pantographic assembly 25 and 25' is a separate four-bar linkage comprised of: track mechanisms 23, 23'; mounting bracket members 24, 24'; and pairs of arms 26, 27 and 26', 27', respectively, mounted therebetween. For the ease of description, however, only one pantographic (four-bar linkage) assembly 25 will be described in detail.

Mounting bracket member 24 is preferably provided by a plate member (FIG. 2) formed to be secured to support member 21 (preferably a side wall of cabinet support member 21) by mounting fasteners 45. Pivotally coupled proximate a front portion of bracket member 24 is front arm 26 which pivots about a generally horizontal front bracket pivotal axis 46 extending through corresponding second end 32. Similarly, pivotally coupled proximate an upper rear portion of the bracket member is rear arm 27 which pivots about a generally horizontal rear bracket pivotal axis 47 extending through corresponding second end 33. As viewed in FIG. 2, rear bracket pivotal axis 47 is positioned at a location spaced-apart from front bracket pivotal axis 46. Both the front arm and the rear arm are preferably elongated, substantially rigid, planar bars of similar length which are formed to support track mechanism 23, shelf member 22 and the stored items (28,29).

Track mechanism 23 includes an elongated track base portion 50 adjacently disposed on one side 44 of shelf member 22. Extending upwardly from a rear portion of the track base portion is a rear post member 51. The upper distal end of rear post member 51 is pivotally mounted about a generally horizontal rear post pivotal axis 52 to the corresponding first end 31 of rear arm 27. Hence, rear arm 27 movably couples track base portion 50 to support bracket member 24. Similarly, front arm 26 also movably couples the track base portion to support bracket member 24. FIG. 2, however, illustrates that the track base portion is formed with a front post member 53 extending downwardly therefrom. The first end 30 of front arm 26 is pivotally mounted to front post member 53 about a generally horizontal front post pivotal axis 54.

Rear post pivotal axis 52 is positioned at a location spaced-apart from front post pivotal axis 54 at locations producing pantographic movement of track mechanism 23 such that shelf member 22 is oriented in a near-horizontal orientation throughout the arcuate path between the deployed position (FIGS. 1B and 2B) and the elevated stored position (FIGS. 1B and 2B). To achieve the desired orientation, the relative positioning (i.e., the relative direction and distance therefrom) between rear post pivotal axis 52 and front post pivotal axis 54 on track mechanism 23 is substantially similar to the relative positioning between rear bracket pivotal axis 47 and front bracket pivotal axis 46 on bracket member 24. Moreover, the relative positioning between front post pivotal axis 54 and front bracket pivotal axis 46 is substantially similar to the relative positioning between rear post pivotal axis 52 and rear bracket pivotal axis 47. Thus, as front post pivotal axis 54 travels through a forward arcuate path 55 and rear post pivotal axis 52 travels through a rear arcuate path 56, front arm 26 and rear arm 27 remain substantially parallel to each other during pantographic movement of track mechanism 23 between the deployed position and the elevated stored position. Accordingly, such a configuration permits shelf member 22, carried by track mechanism 23, to maintain in a near-horizontal orientation throughout the arcuate path as the front arm and the rear arm pivot about the front bracket pivotal axis 47 and the rear bracket pivotal axis 47, respectively.

Depending on the length of both the front arm and the rear arm, the amount of displacement of the track mechanism between the deployed position and the elevated stored position, relative to the support bracket member, can be varied. To a lesser degree, it will also be understood that the height of the front post and the rearward post also may control the height and displacement of the track mechanism.

In the preferred embodiment, a torsion bar 43 is laterally positioned between spaced-apart pantographic assemblies 25 and 25' to substantially increase torsional stability therebetween. As best shown in FIGS. 1A and 1B, torsion bar preferably rigidly couples first end 31 of rear arm 27 to first end 31' of rear arm 27'. The resulting torsional stability enables coordinating movement between the pantographic assemblies which enables smooth operation of the pull down shelf assembly as the track mechanism moves between the stored position and the deployed position. The torsion bar, of course, may be located between front arms 26, 26' as well, and need not necessarily be positioned at the distal end thereof.

As above-indicated, shelf member 22 is slidably supported and coupled to the track mechanism between the extended position (phantom lines in FIG. 2A) and the retracted position (solid lines in FIG. 2A). FIG. 1 best illustrates that base portion 50, 50' is C-shaped forming a channel 57, 57' facing inwardly toward shelf member 22. Channel 57, 57' extends longitudinally along C-shaped base portion 50, 50' and is positioned adjacent to opposing side walls 44, 44' of shelf member 22. Track mechanism 23, 23' further includes an elongated T-shaped bracket element 58, 58' mounted longitudinally along respective side walls 44, 44' which is formed and dimensioned for sliding receipt and meshing engagement with respective channel 57, 57' to enable shelf member 22 to slidably move relative to pantographic assemblies 25 and 25'. When shelf member 22 is moved to the extended position (phantom lines in FIG. 2A), increased accessibility to shelf member 22 is provided, especially for the handicapped, because the shelf member may be extended free and clear of the base portions of the track mechanism. Accordingly, when the pantographic assembly is moved to the deployed position, the items stored on the shelf member are even more accessible.

It will be appreciated that the track mechanism could include other sliding devices as well which extend shelf member 22 forward and away from track mechanism 23, such as a rolling track mechanism or the like, without departing from the true spirit and nature of the present invention.

Once shelf member 22 has been extended forward, it has been found desirable to prevent the shelf member from moving back along channel 57, 57' to the retracted position (solid lines in FIG. 2A) during pantographic movement of track mechanism 23 between the deployed position and the elevated stored position. In the instance where two or more shelves are mounted atop one another, interference between upper pull down shelf assembly 20 and items 28,29 stored on a lower shelf member 39 may inhibit movement of the upper pantographic assembly if the upper shelf member is moved to the retracted position. FIGS. 2A and 2B show that the arcuate movement of track mechanism 23 may cause the rear portion of the upper shelf member to interfere or collide with items 28,29 stored near the front of lower shelf 39. Therefore, by prohibiting retraction of shelf member 22 back to the retracted position, during movement of the pantographic assemblies between the deployed and stored positions, this problem may be effectively eliminated.

Figure 3:
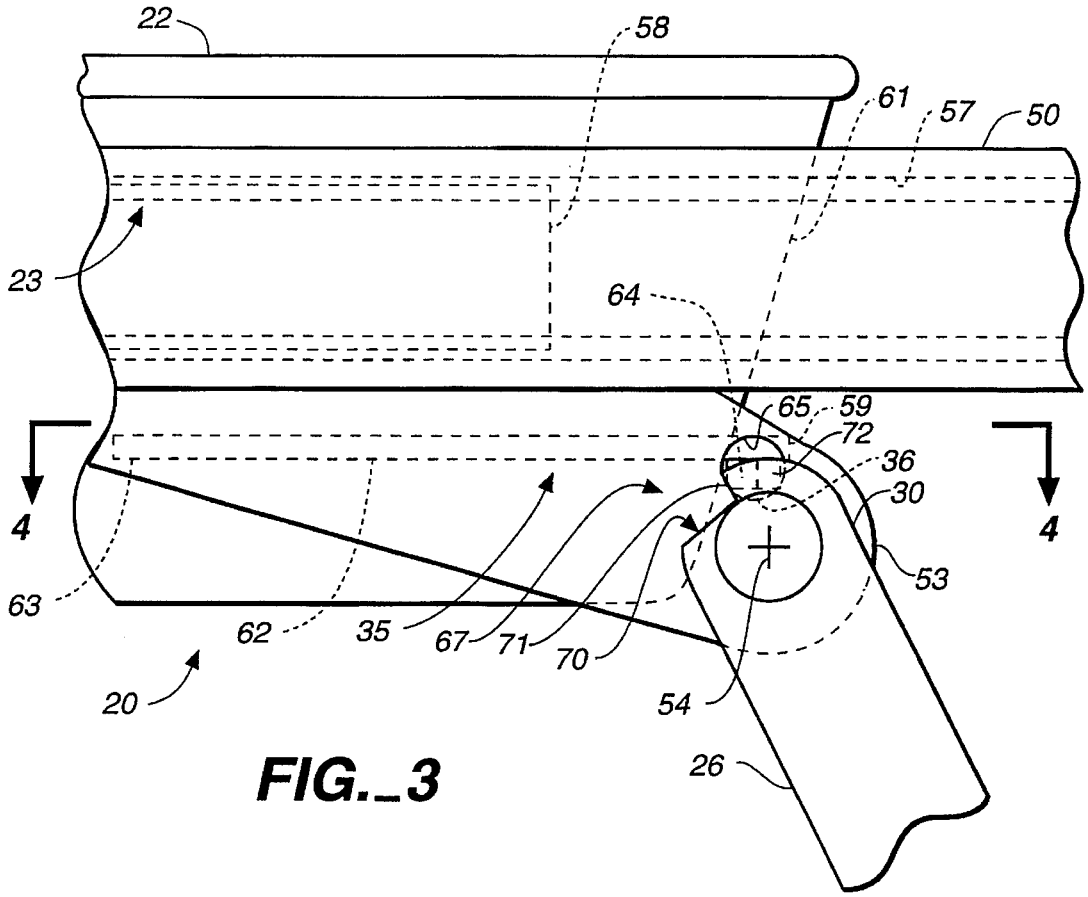
FIG. 3 is an enlarged, fragmentary, side elevation view of the pull down shelf assembly moved from the elevated stored position and illustrating a locking mechanism locking the shelf member in the extended position.

To prevent such retractable movement, each pull down shelf assembly 20 includes shelf locking mechanism 35, 35', as best shown in FIGS. 3 and 4, for releasably locking shelf member 22 in the extended position. It will be understood that locking mechanism 35 can only be moved to the engaged position when shelf member 22 is fully moved forward to the extended position, and when the pantographic assembly is not situated at the elevated stored position. Once locked, shelf member 22 can only be retracted when locking mechanism 35 is disengaged which releases shelf member 22. In the preferred embodiment, release occurs when track mechanism 23 is placed in the stored position and not at any time during pantographic movement of track mechanism 23 between the deployed position and the elevated stored position. In accordance with the present invention, once the assembly is moved to the stored position, the locking mechanism is moved to the disengaged position which permits slidable movement of the shelf member back to the retracted position.

Figure 4B:
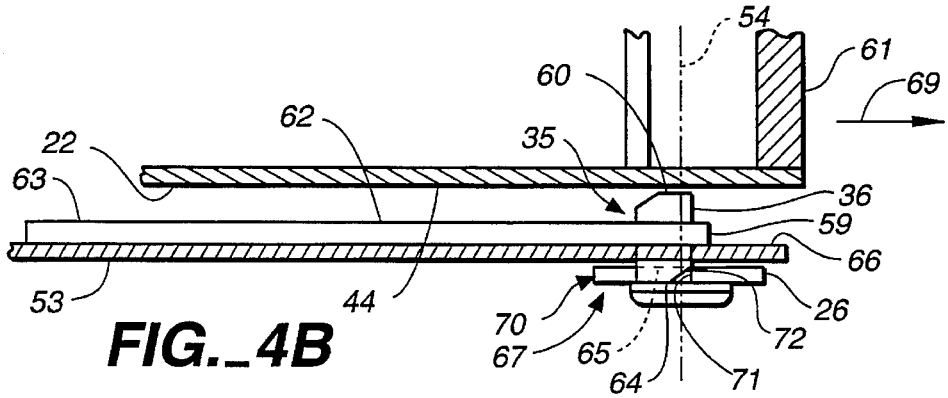

In the preferred form, locking mechanism 35 includes a pin member 36 mounted to track base portion 50 for movement between the engaged position (FIG. 4A) and the disengaged position (FIG. 4B). In the engaged position, a contact end 60 of pin member 36 is situated for abutting contact with a rear wall 61 of shelf member 22 so that shelf member is prevented from moving in the direction of arrow 69 (FIG. 4A (i.e., toward the retracted position)) along the track mechanism. FIG. 4B illustrates that once the pantographic assembly moves to the elevated stored position, as will be described in greater detail below, the pin member is moved to the disengaged position which moves contact end 60 of the pin member out of abutting contact with shelf rear wall 61. Accordingly, shelf member 22 will be permitted to move back toward the retracted position.

Locking mechanism 35 includes an elongated resilient rod member 62 having one end 63 fixedly welded or integrally molded to front post member 53 and an opposite end 59 coupled to pin member 36. Accordingly, pin member 36 is cantilevered about fixed one end 63 in a manner biasing pin member 36 toward the disengaged position, where the shelf member is free to reciprocate between the extended and retracted position.

In accordance with the present invention, pin member 36 further includes a cam engaging end 64 situated opposite contact end 60. Front post member 53 includes an opening 65 formed and dimensioned to permit cam engaging end 64 to extend therethrough so that the engaging end slidably engages a side wall 66 of front arm 26 proximate front post pivotal axis 54. As shown in FIGS. 3 and 4A, contact between cam engaging end 64 and arm side wall 66, which causes pin member 36 to move toward the engaged position, occurs when the pantographic assembly is not situated in the elevated stored position.

Locking mechanism 35 further includes release mechanism 67 operably coupled thereto for releasing the shelf member from the extended position. The release mechanism is preferably engaged along the arcuate pantographic movement of track mechanism 23 when it reaches the elevated stored position. FIGS. 3 and 4B illustrate that release mechanism 67 is provided by a receiving slot 70 formed in arm side wall 66 and dimensioned to receive cam engaging end 64 therein which, in turn, moves pin member contact end 60 out of engagement with shelf rear wall 61. That is, upon alignment of the receiving slot with the cam engaging end, resilient rod member 62 urges pin member toward the disengaged position (FIG. 4B) so that shelf member can be retracted in the direction of arrow 69.

Receiving slot 70 is situated along arm side wall 66 at a location providing alignment with cam engaging end 64 when the pantographic assembly is in the elevated stored position. Accordingly, as the pantographic assembly moves between the deployed position and the elevated stored position, cam engaging end 64 slides along arm side wall 66, in a pivotal manner about front arm pivotal axis, until it is aligned with receiving slot 70.

Preferably, the locking mechanism cannot be moved to the engaged position when shelf member 22 is not moved to the extended position. Hence, in order to lower pantographic assembly to the deployed position, shelf member must first be manually moved from the retracted position (solid lines in FIG. 2A) to the extended position (phantom lines in FIG. 2B). This moves the shelf side wall 44 beyond pin member contact end 60 which permits the pin member to move toward the engaged position. Subsequently, the pantographic assembly can be moved toward the deployed position where a contact edge 71 (FIGS. 3 and 4), which forms receiving slot 70, slidably contacts an inclined ramp portion 72 of cam engaging end 64 during pivotal movement of front arm 26 about front arm pivotal axis 54. Contact with the ramp portion 72 causes pin member 36 to move toward the engaged position until the engaging end is moved into slidable contact with arm side wall 66. Hence, pin member 36 will be retained in the engaged position and shelf member 22 will be prevented from moving toward the retracted position during pantographic movement of the track mechanism between the deployed position and the elevated stored position.

As above-mentioned, shelf member 22 could be movable between the extended and retracted positions while the track mechanism is fully moved to the deployed positions. Accordingly, by providing a second receiving slot (not shown) along arm side wall 66 at a position where cam engaging end 64 is in contact therewith when track mechanism 23 is moved to the deployed position, pin member will be allowed to move to disengaged position. This permits movement of shelf member 22 between the extended and retractable positions until the track mechanism is once again moved between the deployed and the stored positions.

The pull down shelf assembly of the present invention further includes spring biasing mechanism 37 formed to bias the pantographic assembly 25 toward the elevated stored position. Preferably, as best viewed in FIGS. 2 and 5, spring biasing mechanism 37 is provided by a helical spring 40 coupled between the second end 33 of rear arm 27 and mounting bracket member 24. In particular, one end 72 of helical spring 40 is coupled to rear arm 27 proximate second end 33, while an opposite end 73 of spring 40 is secured to spring tension adjustment mechanism 42. Thus, when track mechanism 23 is moved to the deployed position, helical spring 40 is increasingly tensioned about a spring axis 41 which is positioned in coaxial alignment with rear bracket pivotal axis 47. This, in turn, facilitates movement of track mechanism 23 from the deployed position back to the elevated stored position.

The spring constant (k) may be varied, depending on the desired opposing force. Moreover, as will described below, a spring tension adjustment mechanism 42 is included which is formed to increase or decrease the tension of helical spring 40 relative the rear arm. The spring biasing force, however, should not be so large as to automatically return track mechanism 23 to the elevated stored position without the manual aid of the user.

Figure 5:
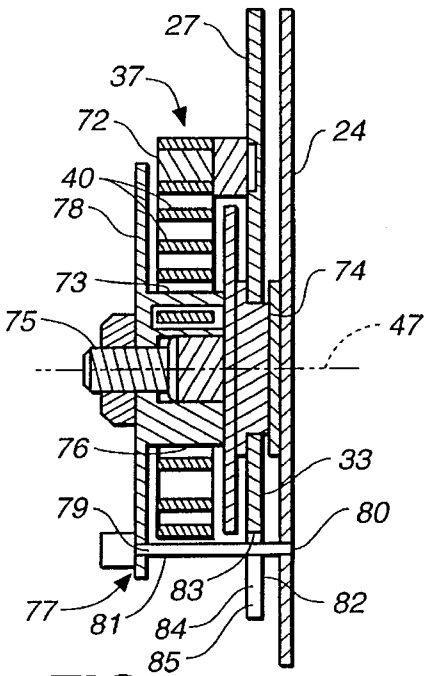
FIG. 5 is an enlarged fragmentary, front elevation view, in cross-section, of a spring biasing mechanism of the pull down shelf assembly taken substantially along the plane of line 5—5 in FIG. 2A.

In the preferred form, rear arm 27 is mounted to a bearing member 74 (FIG. 5) for pivotal movement about rear bracket pivotal axis 47. Bearing member 74 is fixedly mounted to mounting bracket member 24 and includes a bolt member 75 protruding therefrom upon which helical spring 40 and tension adjustment mechanism 42 are rotatably supported. FIG. 5 illustrates that tension adjustment mechanism 42 includes a central hub member 76 upon which the opposite end 73 of helical spring 40 is mounted so that the spring will be increasingly tensioned as the rear arm pivots about rear bracket pivotal axis 47 toward the deployed position.

Moreover, and in accordance with the present invention since the opposite end 73 of spring 40 is fixed to the central hub member, selective manual rotation of a circular flange 78 of the hub member about bolt member 75 causes the spring tension to increase or decrease. FIG. 2A best illustrates that rotation of the central hub member about spring axis 41 in the clockwise direction, relative rear arm 27, will increase the tension of the helical spring 40, while rotation in the counter-clockwise direction will decrease the tension of the helical spring.

The spring tension adjustment mechanism 42 includes a retaining mechanism 77 coupled to hub member 76 for selectively retaining the position of circular flange 78 about the spring axis. As shown in FIG. 2, the circular flange includes a plurality of apertures 79 positioned radially about spring axis 41 and spaced-apart equal distantly. Retaining mechanism 77 further provides a hole 80 (FIG. 5) extending through bracket member 24 upon which one of apertures 79 is to be axially aligned (when hub member is rotated about rear bracket pivotal axis 47). Once the desired tension has been manually set and the chosen aperture 79 has been coaxially aligned with hole 80, a removable locking pin 81 may be inserted through the selected one aperture 79 and into hole 80. Accordingly, by aligning the proper aperture with receiving hole 80, and positioning locking pin 81 removably through the aligned hole and aperture, the circular flange is fixed relative bracket member 24 so that the spring tensioning can be set.

The spring tension adjustment mechanism may also be provided by a ratchet mechanism mounted between central hub 76 and bearing member 74 where tensioning may be increased by rotating hub member 76 about pivotal axis 47. The ratchet mechanism permits incremental increases in tensioning which will be retained until the ratchet mechanism is released.

It will be appreciated that the spring biasing mechanism and the spring tension adjustment mechanism combination could have been operably coupled to front arm 26 rather than rear arm 27 without departing from the nature of the present invention.

In another embodiment of the present invention, a movement limiting mechanism 82 may be provided which limits the movement of the pantographic assembly. FIGS. 2A and 2B illustrate that rear arm 27 includes an edge 83, proximate second end 33, which defines an elongated recess 84 radially positioned around rear bracket pivotal axis 47. Elongated recess 84 is dimensioned to receive locking pin 81 transversely therein so that rear arm 27 can reciprocate between the elevated stored position and the deployed position without interference. However, when the pantographic assembly is moved to the elevated stored position (FIG. 2A), one end 85 of edge 83 contacts the locking pin thereagainst to limit movement, while in the deployed position (FIG. 2B), an opposite end 86 of edge 83 contacts the locking pin thereagainst to limit movement in that direction. Accordingly, by controlling the length and/or positioning of elongated recess 84, relative locking pin 81, the positioning of track mechanism 23 can be controlled in both the elevated stored position and in the deployed position.

What is claimed is:

1. A pull down shelf assembly comprising:

a shelf guide track mechanism;

a storage shelf member mounted to said track mechanism for movement between an extended position and a retracted position;

a pantographic assembly including a shelf mounting bracket member formed for mounting of said shelf assembly to a support member, and a pair of arms pivotally mounted at first ends to said track mechanism at spaced apart locations and pivotally mounted about a pivotal axis at second ends to said mounting bracket member at spaced apart locations, said pair of arms being mounted to said mounting bracket member and said track mechanism at locations producing pantographic movement of said track mechanism with said shelf member carried thereby and oriented in a near-horizontal orientation throughout an arcuate path between a deployed position and an elevated stored position; and a shelf locking mechanism including a pin member movably mounted to one of said track mechanism and one arm of said pair of arms between a disengaged position and an engaged position, positioning said pin member for contact with said shelf member to prevent said shelf member from moving from said extended position upon movement of said track mechanism between said elevated stored position and said deployed position.

2. The pull down shelf assembly as defined in claim 1 wherein, said shelf locking mechanism includes a release mechanism operably coupled thereto for releasing said locking mechanism from said engaged position, said release mechanism being positioned for engagement with said one arm when said track mechanism is in said elevated stored position to release said locking mechanism to enable said shelf member to be moved to said retracted position.

3. A pull down shelf assembly as defined in claim 2 wherein, said shelf locking mechanism includes an elongated resilient rod member biasing said pin member toward said disengaged position and having one end mounted to said one of said track mechanism and said one arm, and an opposite end mounted to said pin member.

4. The pull down shelf assembly as defined in claim 3 wherein, the one end of said rod member is mounted to said track mechanism, and said pin member includes a cam surface formed to contact said one arm to urge said pin member toward the engaged position upon movement of said track mechanism between said deployed position and said elevated stored position.

5. The pull down shelf assembly as defined in claim 4 wherein, said release mechanism is provided by a receiving slot defined in said one arm and formed and dimensioned to receive said pin member therethrough when said track mechanism is moved to said elevated stored position to permit said pin member to move_to said disengaged position.

6. The pull down storage shelf assembly as defined in claim 5 further including:

a spring biasing mechanism coupled between said bracket member and one of said arms for biasing said track mechanism toward said elevated stored position.

7. The pull down shelf assembly as defined in claim 1 wherein, said pantographic assembly includes a pair of laterally spaced-apart pantographic assemblies positioned on opposite sides of said shelf member.

8. The pull down shelf assembly as defined in claim 7 further including:

a torsion bar extending laterally between one pantographic assembly to the other pantographic assembly of said pair of pantographic assemblies.

9. The pull down shelf assembly as defined in claim 7 wherein, each track mechanism of each said pantographic assembly includes an elongated track base portion adjacently disposed along said opposite sides of said shelf member.

10. The pull down shelf assembly as defined in claim 9 wherein, each said base portion defines C-shaped channels extending longitudinally therealong and formed to slidably receive opposing sides of said shelf member for guiding movement of said shelf member relative to said base portions between said extended position and said retracted position.

11. The pull down shelf assembly as defined in claim 10 wherein, said opposing sides of said shelf member include bracket members formed for slidable receipt in said C-shaped channels.

12. A pull down shelf assembly comprising:

a shelf guide track mechanism;

a storage shelf member mounted to said track mechanism for movement between an extended position and a retracted position;

a pantographic assembly including a shelf mounting bracket member formed for mounting of said shelf assembly to a support member, and a pair of arms pivotally mounted at first ends to said track mechanism at spaced apart locations and pivotally mounted about respective pivotal axis at second ends to said mounting bracket member at spaced apart locations, said pair of arms being mounted to said mounting bracket member and said track mechanism at locations producing pantographic movement of said track mechanism with said shelf member carried thereby and oriented in a near-horizontal orientation throughout an arcuate path between a deployed position and an elevated stored position;

a helical spring member tensioned about a spring axis and coupled between said bracket member and one of said arms in a manner positioning said spring axis in substantial coaxial alignment with said respective arm pivotal axis for biasing said track mechanism toward said elevated stored position; and a spring tension adjustment mechanism coupled to said spring member to adjust the tension thereof about said spring axis relative said track mechanism.

13. The pull down shelf assembly as defined in claim 12 wherein, one end of said helical spring is coupled to said one arm and an opposite end thereof is coupled to said bracket member.

14. The pull down shelf assembly as defined in claim 12 wherein, said tension adjustment mechanism includes a central hub member mounted for selective rotational movement about said spring axis relative said helical spring and relative said bracket member, one end of said helical spring being fixedly mounted to said one arm and an opposite end thereof being fixedly mounted to said central hub member.

15. The pull down shelf assembly as defined in claim 14 wherein, said tension adjustment mechanism further includes a stop mechanism coupled to said central hub member for selective rotational positioning thereof relative said track mechanism, about said spring axis.

16. The pull down shelf assembly as defined in claim 15 wherein, said stop mechanism includes 1) a hole extending into said bracket member, 2) a locking pin formed and dimensioned for removable receipt in said hole, and 3) a plurality of apertures extending through said central hub member from a front side to a rear side, each aperture of said plurality being spaced-apart and radially positioned about said spring axis, said locking pin slidably extending through one of said apertures and into said hole upon axial alignment of said one aperture with said hole to removable lock said central hub member relative said bracket member.

17. The pull down shelf assembly as defined in claim 15 wherein, said stop mechanism is provided by a ratchet mechanism providing incremental tensioning of adjustment mechanism.

18. The pull down shelf assembly as defined in claim 14 wherein, said one end of said helical spring is an outer coil thereof, and said opposite end of said helical spring is an inner coil thereof.

19. The pull down shelf assembly as defined in claim 18 wherein, said one arm includes a movement limiting mechanism limiting pantographic movement of said track mechanism in one of the elevated stored position and the deployed position.

20. The pull down shelf assembly as defined in claim 19 wherein, said limiting mechanism is provided by an edge defining an elongated recess in said one arm dimensioned to slidably receive said locking pin therein between said deployed position and said elevated stored position, one end of said edge being formed to contact said locking pin thereagainst upon movement to said elevated stored position, and an opposite end of said edge being formed to contact said locking pin thereagainst upon movement to said deployed position.

21. The pull down storage shelf assembly as defined in claim 14 further including:

a shelf locking mechanism positioned between said track mechanism and said shelf member and movable between an engaged position, locking said shelf member in the extended position during movement of said track mechanism between said deployed position to said elevated stored position, and a disengaged position.

22. The pull down shelf assembly as defined in claim 21 wherein, said pantographic assembly include a pair of laterally spaced-apart pantographic assemblies positioned on opposite sides of said shelf member.

23. The pull down shelf assembly as defined in claim 22 further including:

a torsion bar extending laterally between one pantographic assembly to the other pantographic assembly of said pair of pantographic assemblies.

24. The pull down shelf assembly as defined in claim 23 wherein, each track mechanism of each said pantographic assembly includes an elongated track base portion adjacently disposed along said opposite sides of said shelf member.

* * * * *